US005341968A

United States Patent [19]

Vandoninck

[11] Patent Number: 5,341,968

[45] Date of Patent: Aug. 30, 1994

[54] SPRAY CAN INCORPORATING A DISCHARGE PRESSURE REGULATING SYSTEM

[75] Inventor: Alfons Vandoninck, Deurne, Belgium

[73] Assignee: Belgium Spray Accessory Factory, Opglabbeek, Belgium

[21] Appl. No.: 108,797

[22] Filed: Aug. 29, 1993

[30] Foreign Application Priority Data

Aug. 19, 1992 [BE] Belgium ..... 09200727

[51] Int. Cl.[5] ..... B65D 83/32; B65D 83/70

[52] U.S. Cl. ..... 222/396; 222/464

[58] Field of Search ..... 222/394, 396, 397, 402.1, 222/464; 137/505.14, 505.41, 906

[56] References Cited

U.S. PATENT DOCUMENTS 3,214,061 10/1965 Mills ..... 222/396 X
3,989,061 11/1976 Pelton ..... 137/505.41 X
4,487,334 12/1984 Werding ..... 222/61 X
5,174,326 12/1992 Steinert et al. ..... 137/505.14 X

FOREIGN PATENT DOCUMENTS 0133770 3/1985 European Pat. Off. ..... 222/402.1
0332389 9/1989 European Pat. Off. .... G05D 16/06
0446973 9/1991 European Pat. Off. ..... B65D 83/66
814007 5/1959 United Kingdom ..... 222/396
WO82/00450 2/1982 World Int. Prop. O. ... B65D 83/14

*Primary Examiner*—Kevin P. Shaver
*Attorney, Agent, or Firm*—Bacon & Thomas

[57] ABSTRACT

A spray can including a reservoir, a riser pipe in the reservoir and a valve connected to the riser pipe. The spray can is further provided with a pressure regulator in the riser pipe for maintaining a near constant pressure in the medium being dispensed from the spray can through the riser pipe.

10 Claims, 2 Drawing Sheets

8
7
6
4
2
10
3
5
1
13
F2
11
9
18
12

8
7
6
4
2
10
13
9
18
12
11
1
5
3

SPRAY CAN INCORPORATING A DISCHARGE PRESSURE REGULATING SYSTEM

BACKGROUND OF THE INVENTION

The present invention concerns a spray can.

As is known, conventional spray cans mainly consist of a reservoir which is meant to supply the medium to be atomized, whereby this reservoir is provided with a riser pipe and a valve connected to the riser pipe. The spray can is hereby put under pressure by partly filling the reservoir with a gas under pressure. It is known that with a full spray can this pressure must be relatively high, for example 12 bar, so as to assure that, with an almost empty spray can, there is still enough pressure to displace the medium to be atomized from the reservoir of the spray can, whereby the generally prevailing aerosol legislation should also be taken into account, which says that every spray can should contain 60% fluid filling. The minimum required pressure is usually 3.5 to 4 bar.

Since, at the start, the pressure in the reservoir is high, this causes the medium to be atomized with an undesired great force when the spray can is used.

In order to remedy this disadvantage, it is known to build in a pressure regulator in the valve of the spray can.

This solution is disadvantageous, however, in that when the valve is operated, the medium from the reservoir is atomized in a sputtering manner for various reasons. A first reason consists in that when the valve is opened shut respectively, the medium to be atomized undergoes a sudden pressure change. A second reason consists in that the surface of the pressure regulator where the pressure can act on is very small, such that faults, for example due to contamination, are very quickly felt.

SUMMARY OF THE INVENTION

The present invention aims a spray can which does not have the above-mentioned disadvantages.

To this end the invention concerns a spray can, consisting of a reservoir, a riser pipe in the reservoir and a valve connected to the riser pipe, characterized in that the riser pipe is provided with a pressure regulator.

Because the pressure regulator is not built into the valve of the spray can, but is provided at the height of the riser pipe, the connection between the pressure regulator and the valve acts as a buffer zone and a compensator, as a result of which better outflow characteristics are obtained when the valve is excited, whereby the risk of a sputtering action is reduced.

The fact that the pressure regulator is not built into the valve is also advantageous in that standard valves can be used for the spray cans.

Because the pressure regulator according to the invention is situated in the reservoir, it can be made bigger than a pressure regulator which is built into the valve, as a result of which a larger pressure-sensitive surface can be provided to control the pressure regulator, which results in a pressure regulator that is less sensitive to faults.

According to a preferred embodiment, the pressure regulator is situated at a distance from the valve in order to obtain a sufficiently large buffer zone between the pressure regulator and the valve. More specifically, the pressure regulator is preferably mounted at the entrance of the riser pipe, such that the riser pipe functions entirely as a buffer zone. The buffer effect is hereby reinforced by the elastic expansion of the riser pipe which is usually made of synthetic material.

Preferably, the pressure regulator used hereby consists of a housing with an entrance and an exit; a valve which is placed between the entrance and the exit; and an arrangement for controlling the valve as a function of the pressure at the exit which makes it possible for the valve to increasingly open as the pressure at the exit drops under a certain, preferably adjustable value. This arrangement for controlling the valve preferably comprises a pressure chamber with a movable wall which provides for the movement of the valve of the pressure regulator. In this case, the pressure at which the valve of the pressure regulator and closes respectively, can be easily set by providing the required pressure in the above-mentioned pressure chamber, without the pressure regulator having to undergo any constructional changes. As a result, the pressure regulator offers the advantage that it can be used for different pressure heights without having to undergo any constructional changes, as opposed to the known pressure regulators which are built into the valve of the spray can, which, as is known, are only suited for one particular pressure.

BRIEF DESCRIPTION OF THE DRAWINGS

In order to better explain the characteristics according to the invention, by way of example only and without being limitative in any way, the following preferred embodiments are described with reference to the accompanying drawings, in which.

DETAILED DESCRIPTION OF THE PREFERRED EMBODIMENTS

Figure 1:
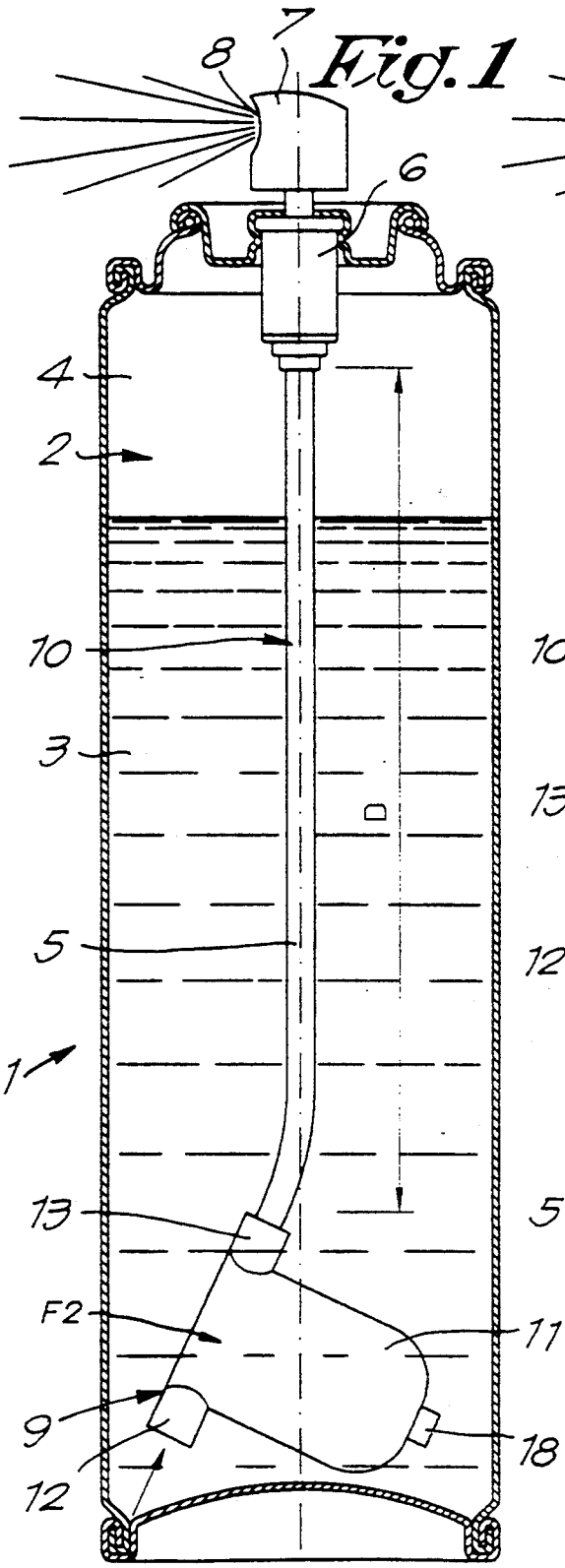
FIG. 1 shows a spray can according to the invention.

As shown in FIG. 1 the spray can 1 according to the invention consists of a reservoir 2 in which the medium 3 to be atomized and the propellant 4 are supplied, a riser pipe 5 and a valve 6 which is connected to the riser pipe 5. The valve 6 is operated by means of a pressure button 7 or the like which is provided with a spray opening 8.

The spray can 1 according to the invention is special in that the riser pipe 5 is provided with a pressure regulator 9 such that, between the pressure regulator 9 and the valve 6, a connection 10 is always provided in which there is a constant or almost constant pressure, which is equal to the regulating pressure of the pressure regulator 9, whereby the connection 10, no matter how small, functions as a buffer zone.

In order to make optimum use of the buffer action, the pressure regulator 9 is preferably mounted at a certain distance D from the valve 6. According to the most preferred embodiment, the pressure regulator 9 is situated at the entrance of the riser pipe 5 as shown in FIG. 1, such that the riser pipe 5 entirely functions as the buffer zone.

In order to further improve the buffer action a riser pipe 5 is preferably used which is deformable under the influence of pressure changes, for example a riser pipe made of an elastic synthetic material.

Figure 2:
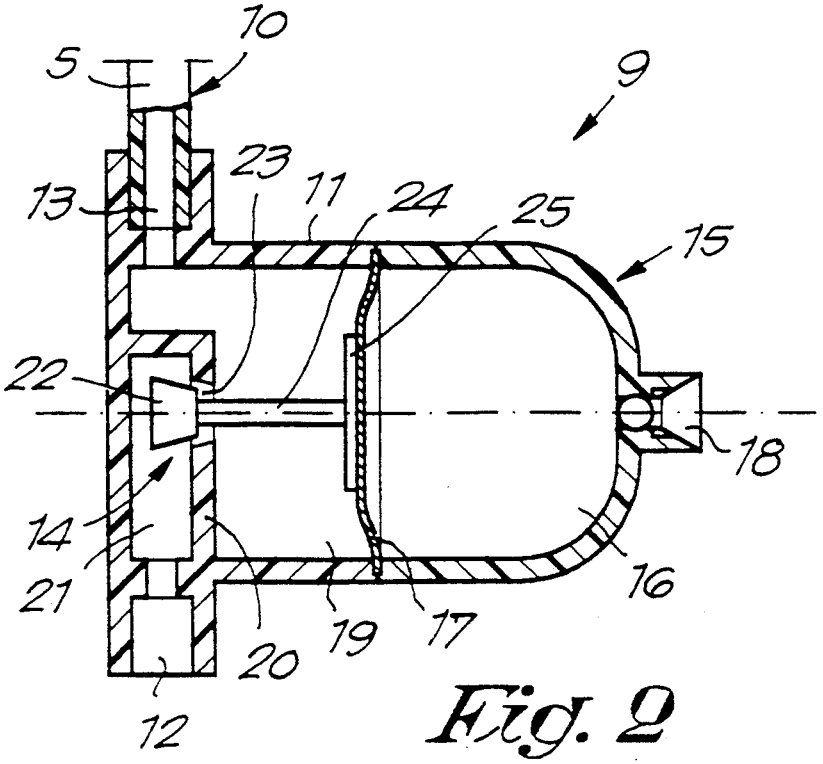
FIG. 2 shows a view of the part which is indicated in FIG. 1 with the arrow F2, to a larger scale and as a section.

The pressure regulator 9 can be of any type whatsoever. As represented in FIG. 2, it preferably consists of a housing 11 with an entrance 12 and an exit 13, a valve 14 which is situated between the entrance 12 and the exit 13, and structure 15 which controls the valve 14 as a function of the pressure at the exit 13, in particular which does not allow the valve 14 to open or to further open respectively, until the pressure at the exit 13 drops under a certain value.

The above-mentioned structure 15 may hereby consist of a pressure chamber 16 which can be filled with a certain amount of gas, whereby pressure chamber 16 has a moveable wall 17, preferably a membrane, which controls the movement of the valve 14. The pressure chamber 16 can be filled by means of a sealable port 18.

The valve 14 may be of any type whatsoever and may be mounted in different places in the housing 11. Naturally, the exit 13 is connected with a room 19 which borders on the moveable wall 17, in particular on the side which is situated opposite to pressure chamber 16, whereby the pressure in the room 19, in conjunction with the pressure in pressure chamber 16, determines the position of the wall 17 and the valve 14. The valve 14 extends through a wall 20 between the room 19 and a space 21 which is connected with the entrance 12.

In the embodiment shown in FIG. 2 the valve 14 consists of a valve head 22 which works in conjunction with an opening 23 in the wall 20 and which is attached to the membrane 17 by means of a valve stem 24 and a membrane dish 25.

The working operation and the use of the spray can 1 can be easily derived from FIGS. 1 and 2.

In a state of rest, the valve 6 is shut. In this case, the pressure regulator 9 assures that a constant pressure is maintained in the connection 10.

As the valve 6 is opened the medium which is present in the connection 10 is atomized, whereby the pressure in the connection 10 decreases, and thus also in the room 19, with as a result that the wall 17 from FIG. 2 moves to the left under influence of the pressure in the pressure chamber 16, as a result of which the valve 14 is opened and the medium 3 to be atomized can leave the reservoir 2. If the pressure in the room 19 becomes too high, however, the wall 17 moves back to the right as a result of which less medium is supplied to the room 19. It is clear that in this way an almost constant pressure is maintained in the room 19.

Figure 3:
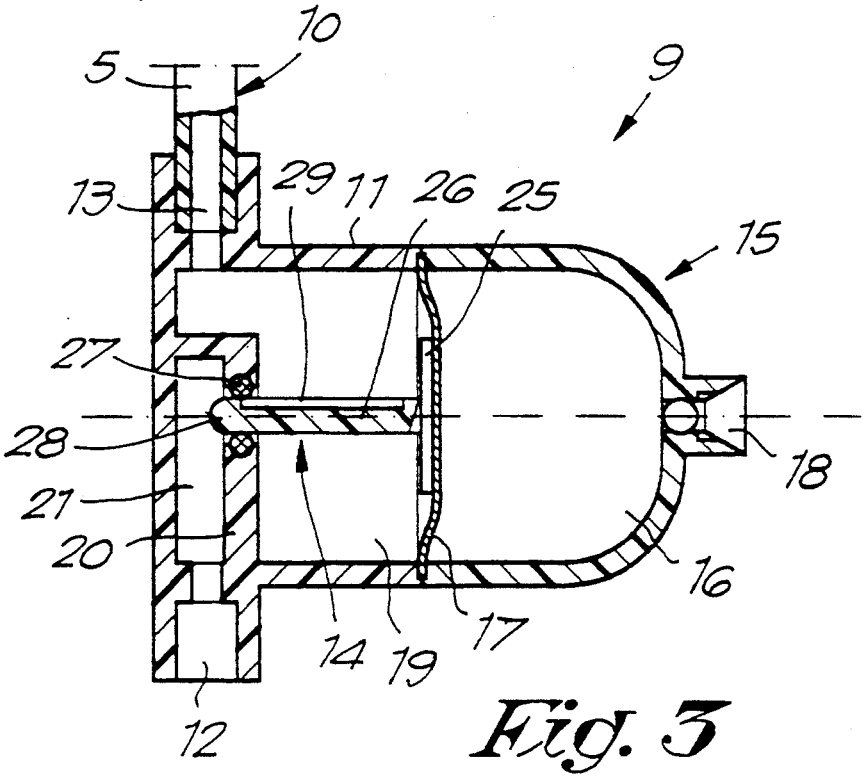
FIG. 3 shows a variant of the part which is represented in FIG. 2.

FIG. 3 shows a variant of the pressure regulator 9 whereby the valve 14 consists of a valve stem 26 which works in conjunction with a sealing member 27 provided in the opening 23 and which is provided, over a certain length, at a distance from its free end 28, with an axial recess 29. FIG. 3 shows the valve 14 when it is shut. When it is opened the valve stem 26 is moved to the left and the recess 29 forms an open connection between the space 21 and the room 19.

It should be noted that the valve 14 may have a leak. Such a leak has no or almost no negative effect on the working of the spray can. When the valve 6 is shut, a high pressure is built up in this case at the exit 13 and in the connection 10 which equals the pressure in the spray can. As the valve 6 is opened, this pressure drops immediately, however, and the pressure is further regulated by means of the pressure regulator 9.

The fact that the valve 14 may also have a leak is advantageously accommodated by the invention in that this valve does not need to be made with great precision. In order to allow for a smooth movement of the valve 14, a deliberately loose fit may even be provided. Thus, the above-mentioned sealing member 27 is not strictly necessary.

It is clear, however, that the maximum leakage should not exceed the minimum delivery during the atomization.

Figure 4:
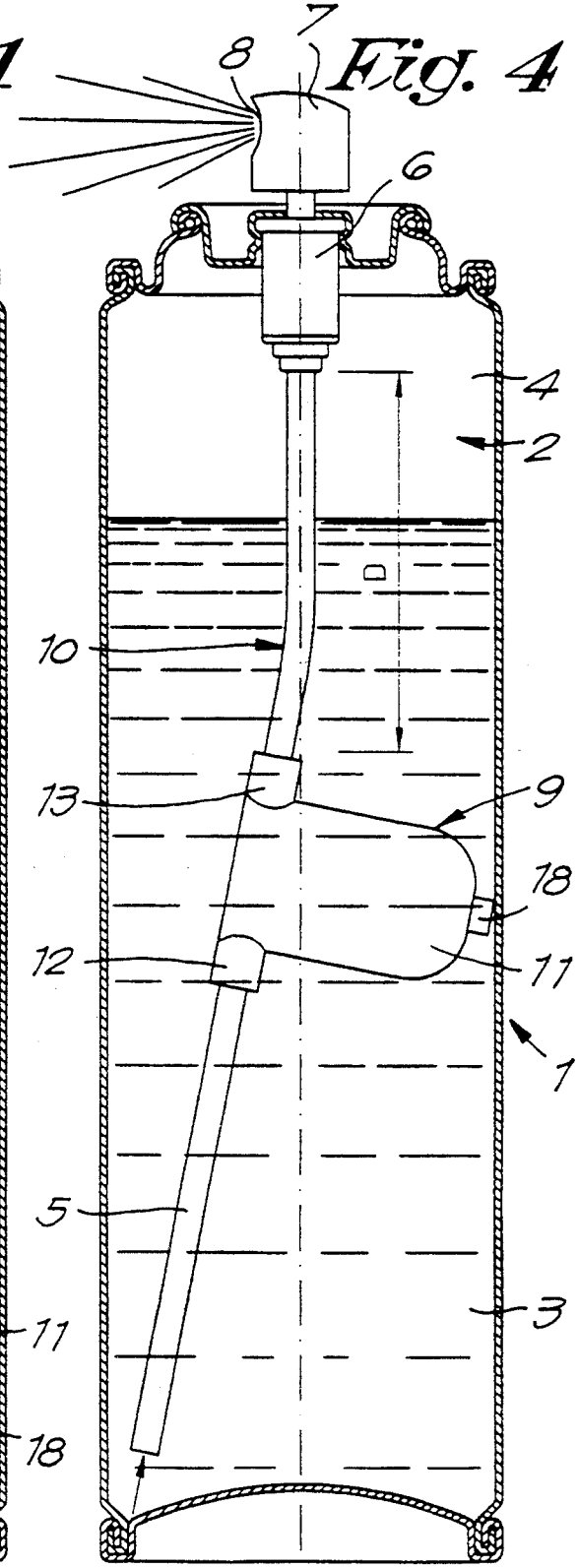
FIG. 4 shows another spray can according to the invention.

It is also clear that the pressure regulator 9 need not be necessarily provided at the bottommost end of the riser pipe 5, but can also be mounted in the middle of the riser pipe as represented in FIG. 4.

The present invention is in no way intended to be limited to the embodiments described by way of example and shown in the accompanying drawings; on the contrary, such a spray can can be made in various forms and dimensions while still remaining within the scope of the invention.

I claim:

1. A spray can comprising a reservoir for storing a dispensable medium, a riser pipe having a first, open end extending into the reservoir, a first valve connected to a second end of the riser pipe and a pressure regulator interposed between the first and second ends of said riser pipe for maintaining the pressure of a medium within a portion of said riser pipe between said pressure regulator and said first valve constant.

2. A spray can according to claim 1, wherein the pressure regulator is situated at a predetermined distance along said riser pipe from the first valve.

3. A spray can according to claim 2, wherein the pressure regulator is situated at the first, open end of the riser pipe.

4. A spray can according to claim 1, wherein the riser pipe is formed from an elastic synthetic material.

5. A spray can according to claim 1, wherein the pressure regulator comprises a housing having an entrance in fluid communication with the reservoir through said riser pipe and an exit in fluid communication with said first valve through said riser pipe, a second valve which is positioned within the housing between the entrance and the exit, and means for controlling said second valve as a function of the pressure at the exit.

6. A spray can according to claim 5, wherein said controlling means comprises a pressure chamber defined within said housing by a movable wall to which the second valve of the pressure regulator is attached and a room which is open to the exit of the pressure regulator and which borders on said movable wall, whereby the pressure in said room determines the position of the second valve.

7. A spray can according to claim 6, wherein the movable wall comprises a membrane.

8. A spray can according to claim 6, wherein the pressure chamber is further provided with a sealable port that opens into said pressure chamber for introducing a pressurized medium into said pressure chamber.

9. A spray can according to claim 6, wherein the valve comprises a second valve head which is attached to the moveable wall by means of a valve stem, said valve head extending into an opening which interconnects the entrance and the exit of the pressure regulator.

10. A spray can according to claim 6, wherein the second valve comprises a valve stem having a first end attached to the moveable wall and a second free end which extends into an opening that interconnects the entrance and the exit of the pressure regulator, said valve stem including, along a portion of its second, free end, an axial recess which provides for an adjustable passage between the entrance and exit.

* * * * *